US010147405B1

(12) United States Patent
Hirasawa

(10) Patent No.: US 10,147,405 B1
(45) Date of Patent: Dec. 4, 2018

(54) DRUM PEDAL DEVICE

(71) Applicant: HOSHINO GAKKI CO., LTD., Nagoya, Aichi (JP)

(72) Inventor: Satoshi Hirasawa, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 15/838,370

(22) Filed: Dec. 12, 2017

(30) Foreign Application Priority Data

Aug. 8, 2017 (JP) ..... 2017-153635

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
USPC ..... 84/422.1
See application file for complete search history.

(56) References Cited

U.S. PATENT DOCUMENTS 3,030,847 A 4/1962 Thompson
5,301,592 A * 4/1994 Johnston ..... G10D 13/006 84/422.1
6,137,040 A 10/2000 Hoshino
8,669,454 B1 * 3/2014 Lin ..... G10D 13/006 84/422.1

FOREIGN PATENT DOCUMENTS

JP 11-212547 A 8/1999

* cited by examiner

*Primary Examiner* — Jianchun Qin

(57) ABSTRACT

A pedal device includes a switching device, which is capable of selectively switching the position of a spring between a use position, at which the spring is disposed during the use of the pedal device, and a non-use position, at which the spring is disposed during the non-use of the pedal device. The switching device is configured such that the length between a first end and a second end of the spring when the spring is disposed at the non-use position is less than the spring length when the spring is disposed at the use position.

8 Claims, 9 Drawing Sheets

10
12
13
14
15
16
17
17a
17b
18
18a
18b
19
20
21
23
25
26
29
30
33b
33c
36
38
40
42
44
45
A1
(A2)
C1
D1
O1
O2

DRUM PEDAL DEVICE

CROSS-REFERENCE TO RELATED APPLICATIONS

This application is based upon and claims the benefit of priority from prior Japanese Patent Application No. 2017-153635, filed on Aug. 8, 2017, the entire contents of which are incorporated herein by reference.

BACKGROUND OF THE INVENTION

The present invention relates to a drum pedal device used in the performance of drums such as a bass drum.

A pedal device disclosed in Japanese Laid-Open Patent Publication No. 11-212547 includes a base coupled to a bass drum, a pair of posts provided at the front end of the base, a pedal pivotally coupled to the rear end of the base, and a wheel coupled to the free end of the pedal with a chain belt. The pedal device further includes a beater attached to the wheel, a shaft, which horizontally extends from the wheel and is pivotally supported by the posts, a cam member fixed to an end of the shaft, and a coil spring.

The upper end of the coil spring is connected to the distal end of the cam member with a spring hook member. The lower end of the coil spring is hooked to a lower bracket provided on the outside of the posts. The pedal device is used in a state where the pedal and the beater are held at respective predetermined angular positions by the tension caused by pulling the upper and lower ends of the coil spring. When the pedal device is not used, the upper end of the coil spring is disengaged from the cam member. This allows the beater to be pivoted to the same portion as that of the pedal after the holding force applied to the pedal and the beater by the coil spring is eliminated. As a result, the beater is folded with respect to the pedal to facilitate storing and carrying of the pedal device.

Attaching and detaching the coil spring each time the pedal device is used is inconvenient to the user and is a burdensome operation. In addition, after the coil spring is disengaged from the cam member, the upper end of the coil spring becomes unfixed. This causes the coil spring to move to be brought into contact with the posts or the pedal when the pedal device is put away or carried, so that the surface of the posts or the pedal may be scratched. In addition, the coil spring may be lost after being disengaged from the cam member. For this reason, U.S. Pat. No. 3,030,847 discloses a pedal device in which the beater is foldable with respect to the pedal without disengaging the coil spring.

The pedal device disclosed in U.S. Pat. No. 3,030,847 includes a base, a pedal, and a cam coupled to the free end of the pedal with a strap belt. The pedal device further includes a beater attached to the cam, a shaft that horizontally extends from the cam, a cylindrical housing that pivotally holds the shaft, and a rocker arm fixed to an end of the shaft that is opposite to the cam. In addition, the pedal device includes a coil spring connected to the distal end of the rocker arm, and a spring arm to which an end of the coil spring that is opposite to the rocker arm is connected. The spring arm is attached to a side end of the housing that is adjacent to the rocker arm with a fixing bolt.

The pedal device disclosed in U.S. Pat. No. 3,030,847 allows the spring arm to be pivotal around its proximal end by loosening the fixing bolt. In addition, the beater can be pivoted to the same position as that of the pedal by pivoting the pedal and the beater in conjunction with pivoting of the spring arm. However, even when the spring arm and the beater are folded with respect to the pedal as described above, the tension of the coil spring does not change and is maintained during the use of the pedal device. As a result, even when the pedal device is not used, the fatigue of the coil spring progresses while the beater is folded with respect to the pedal, and thus the useful life of the coil spring is likely to be shortened.

SUMMARY OF THE INVENTION

It is an object of the present invention to provide a drum pedal device capable of folding a beater with respect to a pedal without disengaging a spring and capable of reducing the fatigue of the spring in a state where the beater is folded.

To achieve the foregoing objective and in accordance with one aspect of the present disclosure, a drum pedal device is provided that includes a device body including a base and a post extending upward from a front end of the base, a pedal pivotally coupled to a rear end of the base, a rotating member, which is coupled to a free end of the pedal with a coupling member and is pivotally supported to an upper end of the post, a beater attached to the rotating member, a spring, and a switching device. The spring includes a first end connected to the rotating member, a second end opposite to the first end, and an axis. The switching device is capable of selectively switching a position of the spring between a use position, at which the spring is disposed during use of the pedal device, and a non-use position, at which the spring is disposed during non-use of the pedal device. The switching device allows a length between the first end and the second end of the spring when the spring is disposed at the non-use position to be less than a length between the first end and the second end of the spring when the spring is disposed at the use position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A drum pedal device 10 according to one embodiment of the present invention will now be described with reference to FIGS. 1 to 8B.

Figure 1:
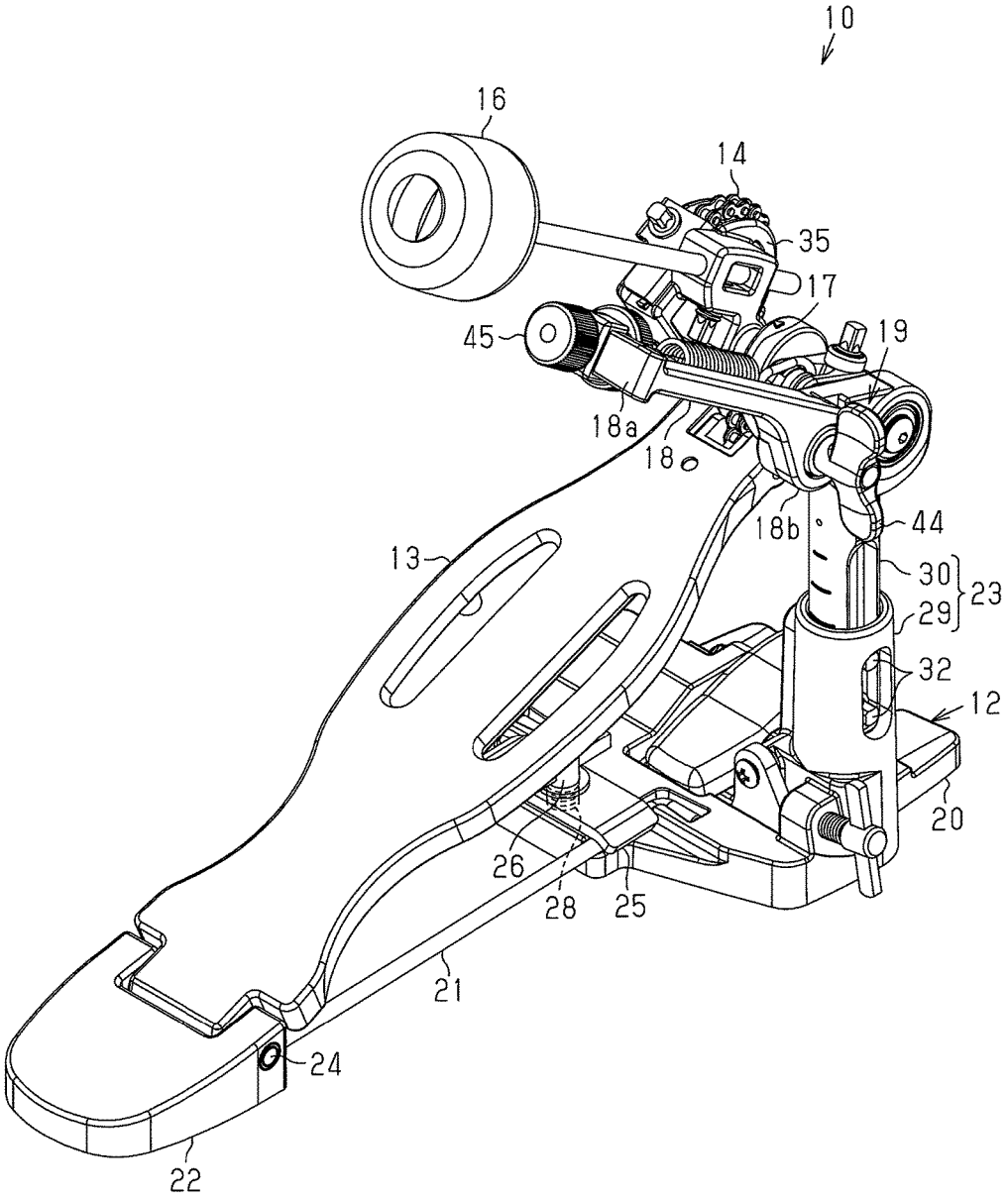
FIG. 1 is a perspective view of a pedal device according to one embodiment of the present invention.
Figure 2:
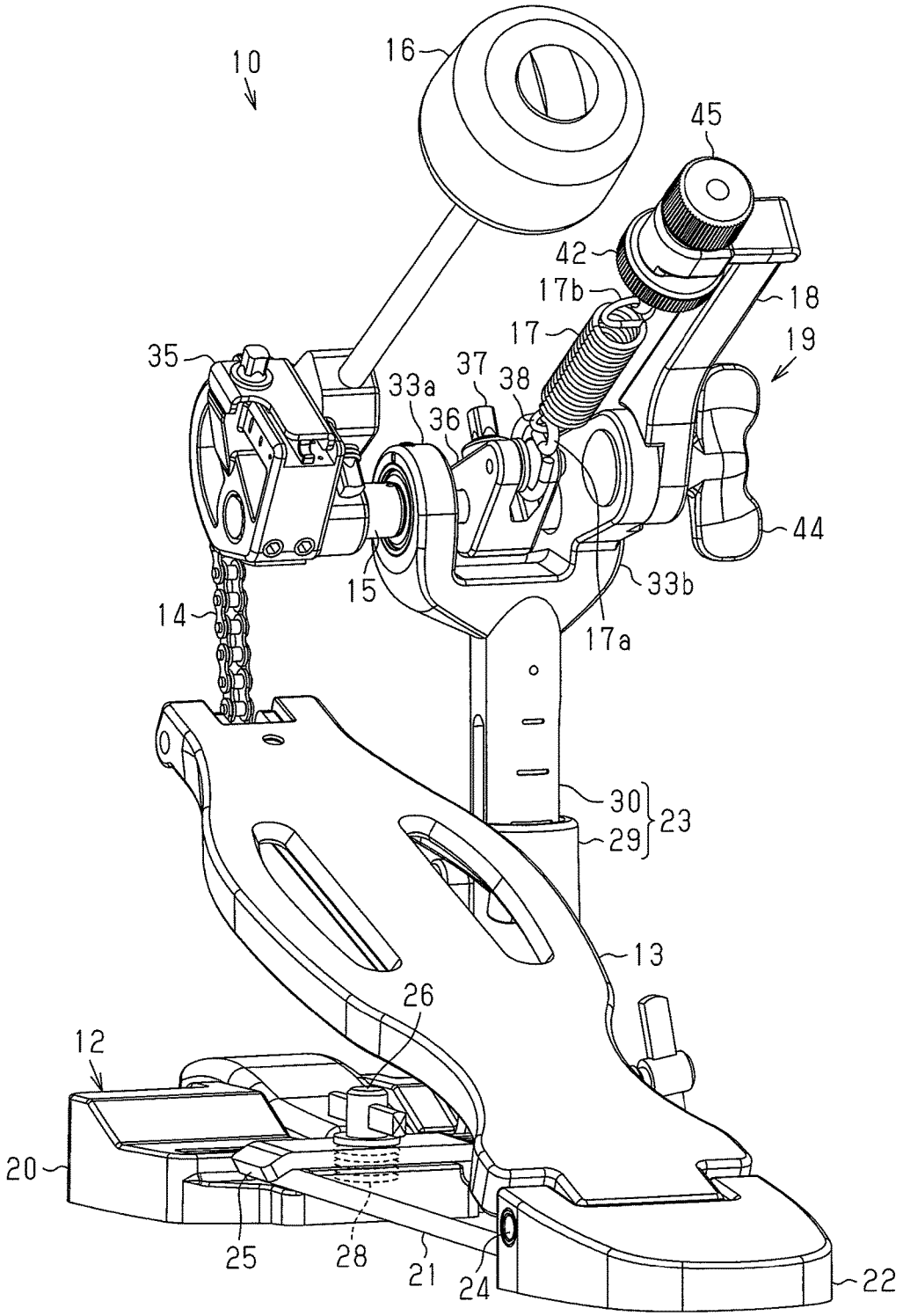
FIG. 2 is a perspective view of the pedal device as viewed from another direction.

As illustrated in FIGS. 1 and 2, the pedal device 10 includes a device body 12, a pedal 13, a chain belt 14 as a coupling member, a shaft 15 as a rotating member, a beater 16, a spring 17 composed of an extension coil, and a spring arm 18. The pedal device 10 further includes a switching device 19, which can selectively switch the position of the spring 17 between a use position, at which the spring 17 is disposed during the use of the pedal device 10, and a non-use position, at which the spring 17 is disposed during the non-use of the pedal device 10.

The device body 12 includes a base plate 20, a rod member 21 in a substantially U-shape coupled to the rear end of the base plate 20, a heel part 22 coupled to the rear end of the rod member 21, and a post 23 extending upward from a side portion of the base plate 20. To the heel part 22, the rear end of the pedal 13 is pivotally attached with a support shaft 24. In the present embodiment, the base plate 20, the rod member 21, and the heel part 22 constitute a base.

The front end of the rod member 21 is attached to the rear end of the base plate 20 with a fixing plate 25 and a T-bolt 26. Loosening the T-bolt 26 allows the fixing plate 25 to be lifted by a spring 28, so that the front end of the rod member 21 can be detached from the rear end of the base plate 20. The device body 12 is configured such that a part of the base is detachable with respect to the proximal end of the post 23 by allowing the front end of the rod member 21 to be detachable with respect to the base plate 20.

Figure 3A:
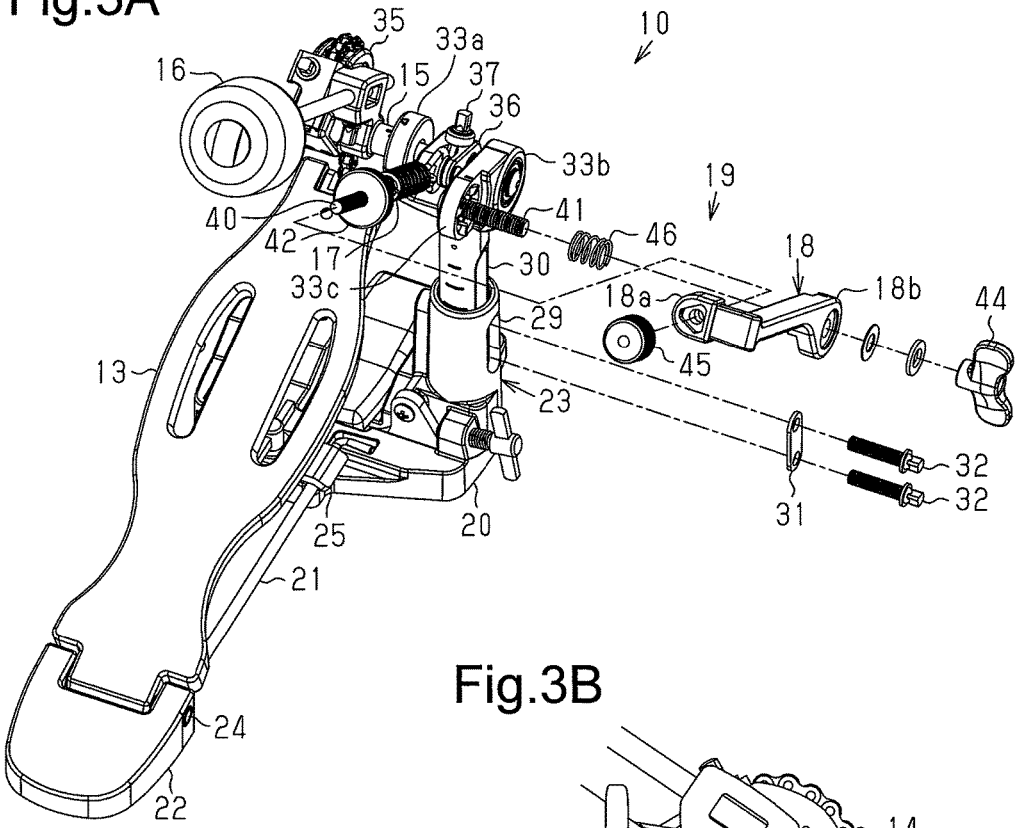
FIG. 3A is an exploded perspective view of the pedal device, illustrating the vicinity of a switching device.
Figure 3B:
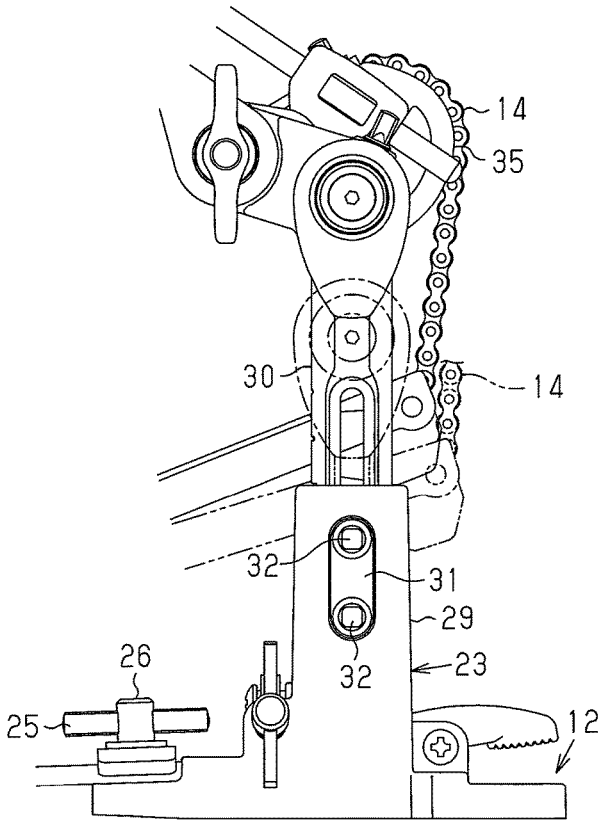
FIG. 3B is a partial side view of the pedal device, illustrating the vicinity of the switching device in an enlarged manner.

As illustrated in FIGS. 2 to 3B, the post 23 includes a cylindrical bottom post member 29 extending upward from the base plate 20, and an upper post member 30 that is slidably disposed inside the bottom post member 29. The upper post member 30 is fixed to the bottom post member 29 at a predetermined height position with a fitting plate 31 and a pair of bolts 32. Loosening the bolts 32 allows the upper post member 30 to be vertically slidable with respect to the bottom post member 29. The device body 12 is configured such that the dimension of the post 23 in its height direction is adjustable by allowing the upper post member 30 to be slidable with respect to the bottom post member 29.

From the upper end of the upper post member 30, a pair of arms 33*a* and 33*b* projects. Each of the arms 33*a* and 33*b* rotationally supports the shaft 15 with bearings (not illustrated). The inner arm 33*a* of the arms 33*a* and 33*b* is disposed near the center of the pedal device 10. A part of the shaft 15 laterally projects from the inner arm 33*a*. The beater 16 and a wheel 35 are fixed to the part of the shaft 15 projecting from the inner arm 33*a*. One end of the chain belt 14 is fixed to the peripheral surface of the wheel 35 while the chain belt 14 is looped over the peripheral surface. The other end of the chain belt 14 is fixed to the free end of the pedal 13, which is the front end of the pedal 13. As a result, the chain belt 14 is pulled downward by the weight of the pedal 13.

For example, as indicated by the long dashed double-short dashed lines in FIG. 3B, when the height of the post 23 is adjusted to lower the position of the pedal 13, the upper post member 30 is first slid with respect to the bottom post member 29 to be disposed at a predetermined height position, and then is fixed to the bottom post member 29 by tightening the pair of bolts 32. When the position of the pedal 13 is excessively lowered by the height adjustment of the post 23, the chain belt 14 is disengaged from the peripheral surface of the wheel 35. Then, while the pedal 13 is lifted to a desired position, the chain belt 14 is fixed to the peripheral surface of the wheel 35 after being looped over the peripheral surface.

A cam 36 is fixed with a screw 37 as a fixing member to the part of the shaft 15 disposed between the arms 33*a* and 33*b*. The screw 37 fixes the cam 36 to the shaft 15 from a direction orthogonal to the axis of the shaft 15. A first end 17*a* of the spring 17 is connected to the distal end of the cam 36 with a hooking member 38. A second end 17*b* of the spring 17 is connected to a distal end 18*a* of the spring arm 18, which has an L-shape, with a bolt 40, an adjustable nut 45, and a lock nut 42. The first end 17*a* and the second end 17*b* are pulled in the axial direction of the spring 17 to cause tension in the spring 17. This tension of the spring 17 holds the pedal 13 and the beater 16 at respective predetermined angular positions.

In this state, releasing the cam 36 and shaft 15 from each other by loosening the screw 37 allows the shaft 15 to be pivotal around the axis of the cam 36, so that the angular position of each of the beater 16 and the pedal 13 becomes adjustable. In addition, the second end 17*b* of the spring 17 is connected to one end of the bolt 40, and the other end of the bolt 40 is screwed into a screw hole of the adjustable nut 45. As a result, when the adjustable nut 45 is turned by hand to adjust the position of the bolt 40 in its axial direction, the tension of the spring 17 is adjusted.

Figure 4:
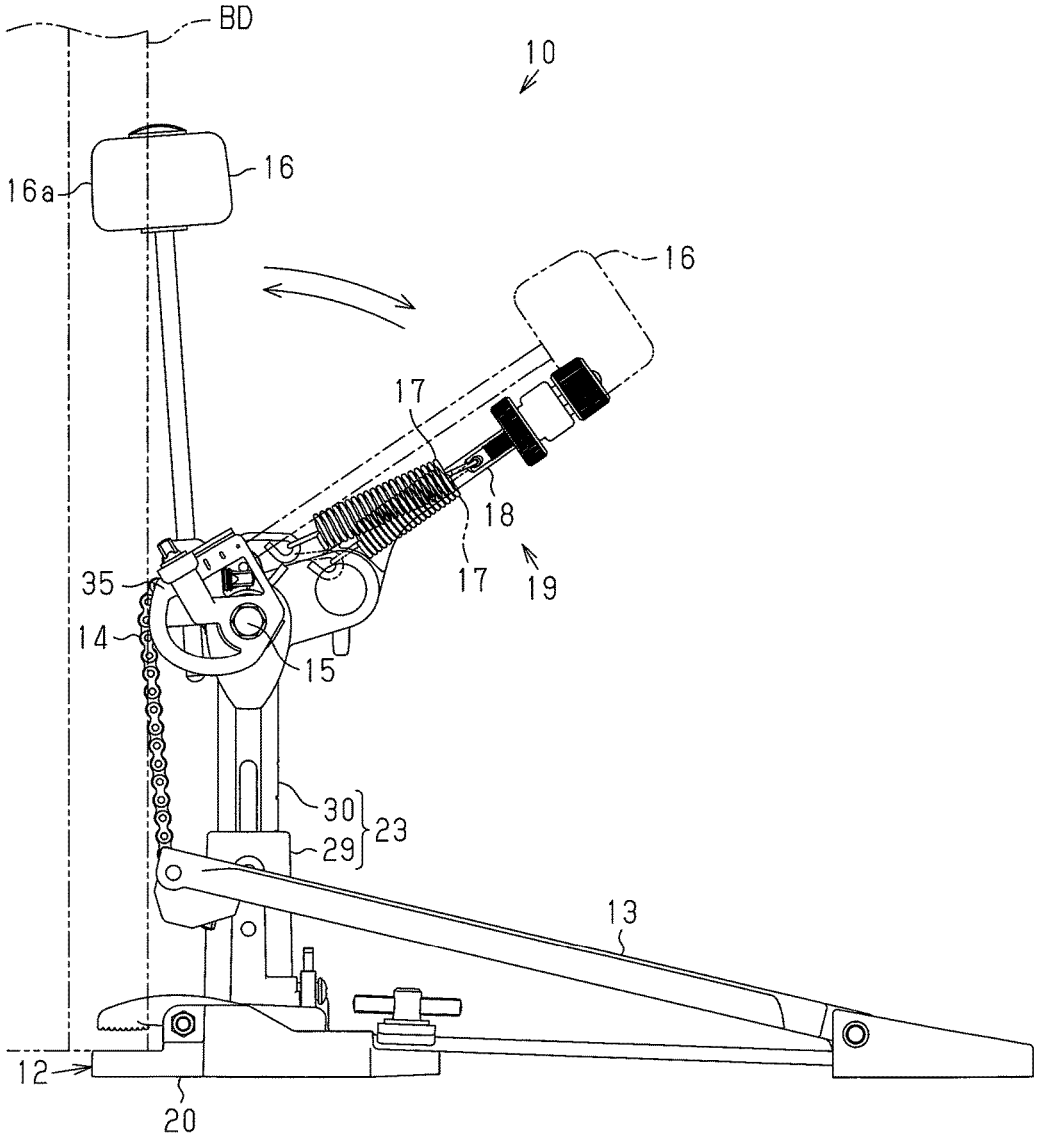
FIG. 4 is an explanatory side view illustrating an action of the pedal device.

As illustrated in FIG. 4, the pedal device 10 is used in a state where a beating surface 16*a* of the beater 16 is disposed so as to face a bass drum BD and the base plate 20 is coupled to the bass drum BD. In this state, when the player steps on the pedal 13 by foot, the stepping force is transmitted to the wheel 35 through the chain belt 14. Then, the beater 16 is turned together with the wheel 35 and the shaft 15 toward the drum head of the bass drum BD. When the player releases the pedal 13, the beater 16 is turned together with the wheel 35 and the shaft 15 in the direction away from the drum head by the tension caused by pulling the spring 17. In this way, when the pedal 13 is vertically moved by using foot, the beater 16 is oscillated together with the shaft 15.

As illustrated in FIG. 3A, the spring arm 18 is attached to the outer arm 33*b* of the arms 33*a* and 33*b*, which is disposed away from the center of the pedal device 10. Thus, the outer arm 33*b* includes a projecting portion 33*c* projecting backward so that the spring arm 18 can be attached to the projecting portion 33*c*. A bolt 41 is fixed to the projecting portion 33*c* with the axis of the bolt 41 being directed laterally. The bolt 41 is inserted into a proximal end 18*b* of the spring arm 18 through a spring 46, and the distal end of the bolt 41 is attached to a butterfly nut 44 with a washer. The spring arm 18 is fixed to the outer arm 33*b* by tightening the butterfly nut 44, and becomes pivotal with respect to the outer arm 33*b* by loosening the butterfly nut 44.

The spring arm 18 is configured so as to be able to be placed in one pivot position for disposing the spring 17 at a use position, and two different pivot positions for disposing the spring 17 at respective non-use positions. In the two different pivot positions, a position for disposing the spring 17 at a lower non-use position to fold the spring arm 18 is defined as a first folding position, and a position for disposing the spring 17 at an upper non-use position to fold the spring arm 18 is defined as a second folding position. Thus, the outer arm 33*b* of the upper post member 30 and the proximal end 18*b* of the spring arm 18 are each provided with a positioning means for disposing the spring arm 18 at any one of the pivot position corresponding to the use position of the spring 17 and the pivot position corresponding to the non-use position of the spring 17.

Figure 5A:
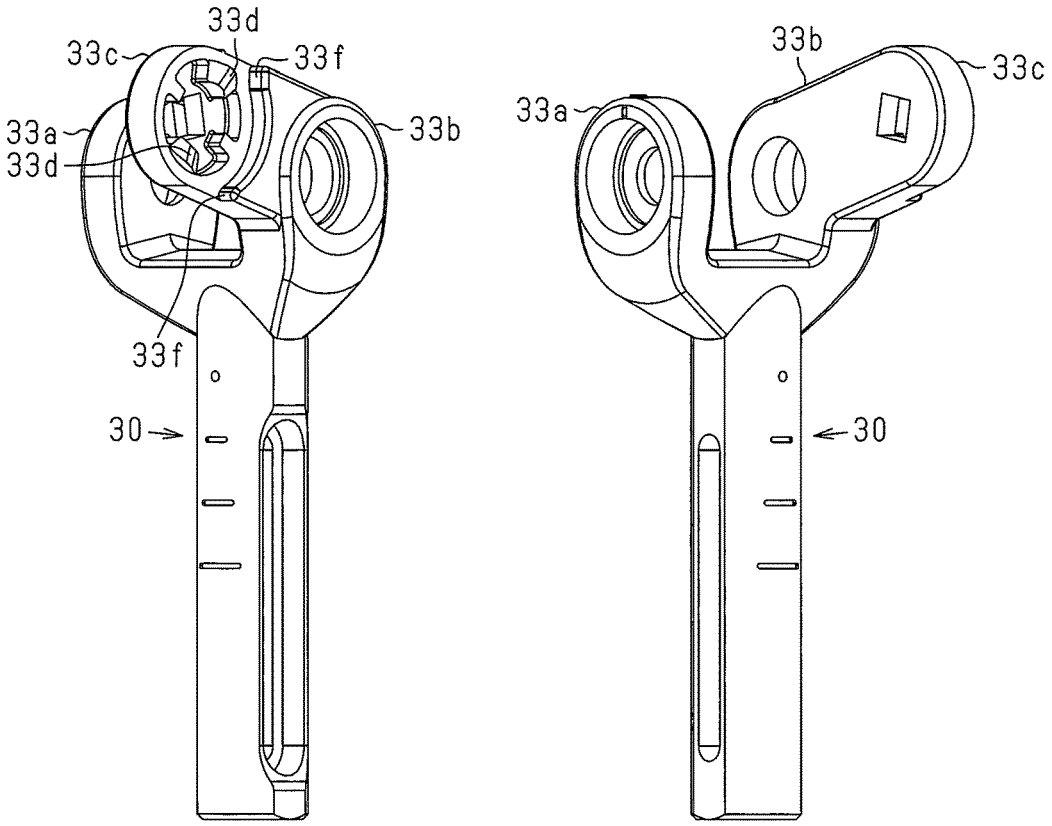
FIG. 5A is a perspective view of an upper post.
Figure 5B:
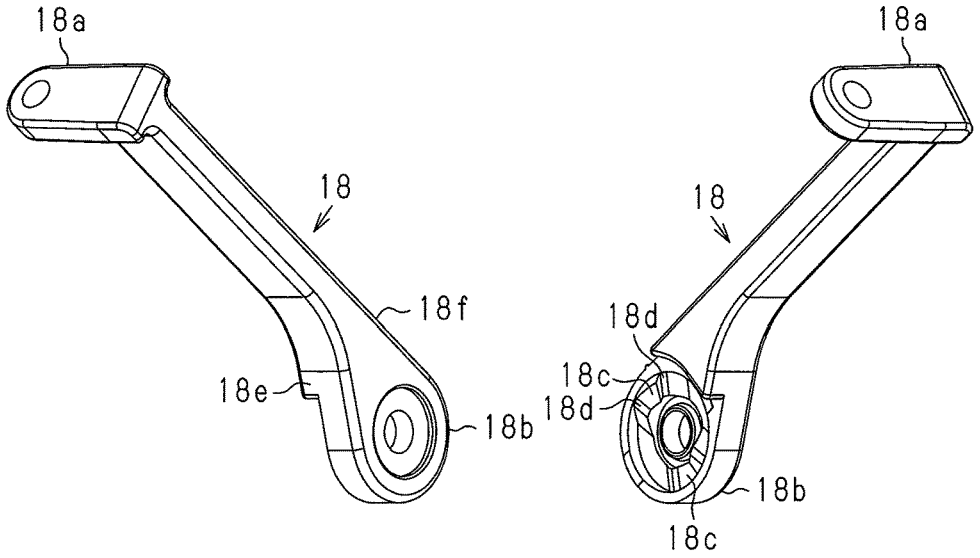
FIG. 5B is a perspective view of a spring arm.

As illustrated in FIGS. 5A and 5B, in the projecting portion 33*c* of the outer arm 33*b*, a pair of upper and lower protrusions 33*d* is formed as the positioning means corresponding to the use position of the spring 17. The respective protrusions 33*d* are disposed at an angular interval of 180 degrees to correspond to the pivot position of the spring arm 18 for the use position. In the proximal end 18*b* of the spring arm 18, a pair of upper and lower recesses 18*c* is formed as the positioning means corresponding to the above use position. Each of the recesses 18*c* is formed between two protrusions 18*d* and has a shape to be fitted to the corresponding one of the protrusions 33*d* of the outer arm 33*b*.

In the outer arm 33*b*, a pair of upper and lower stepped portions 33*f* is formed as the positioning means corresponding to the non-use position of the spring 17. Each of the stepped portions 33*f* is formed near the proximal end of the projecting portion 33*c*. When the spring arm 18 is disposed at the first folding position to allow the spring 17 to be disposed at the lower non-use position, a lower surface 18*e* of the spring arm 18 is brought into contact with the lower stepped portion 33*f* of the outer arm 33*b* to restrict further pivoting of the spring arm 18. In contrast, when the spring arm 18 is disposed at the second folding position to allow the spring 17 to be disposed at the upper non-use position, an upper surface 18*f* of the spring arm 18 is brought into contact with the upper stepped portion 33*f* of the outer arm 33*b* to restrict further pivoting of the spring arm 18.

As illustrated in FIGS. 6A to 8B, the switching device 19 includes the spring arm 18, the outer arm 33*b* of the upper post member 30, and the butterfly nut 44. The switching device 19 is configured such that each of lengths D2 and D3 (hereinafter referred to as spring lengths) between the first end 17*a* and the second end 17*b* of the spring 17 when the spring 17 is disposed at the corresponding one of the non-use positions is less than a spring length D1 when the spring 17 is disposed at the use position. The switching device 19 is also configured such that the spring length becomes the natural length when the spring 17 is disposed at the non-use position to fold the beater 16 to the pedal 13.

Figures 6A, 6B:
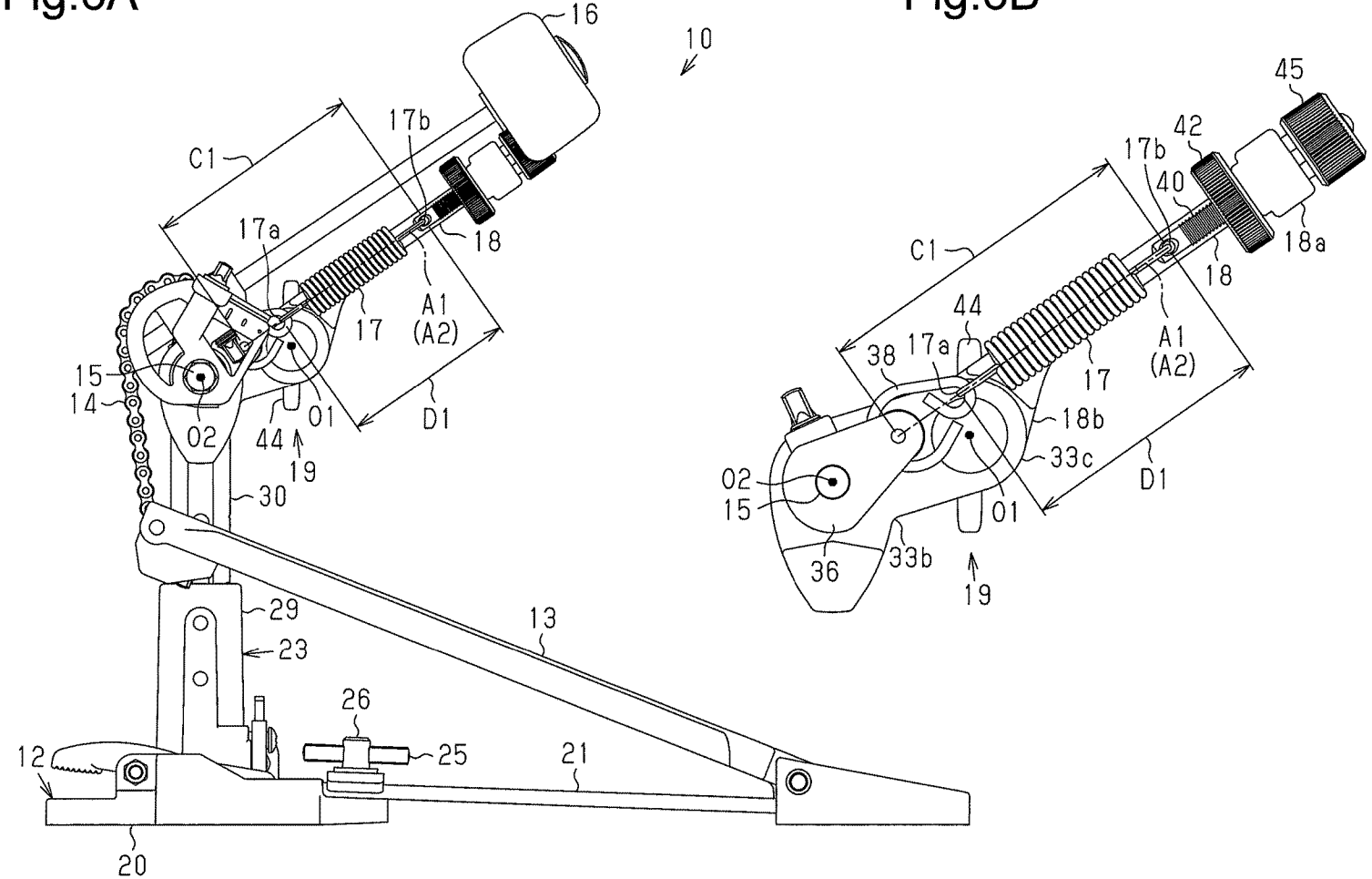
FIG. 6A is a side view of the pedal device in a state where the spring arm is fixed to an outer arm while a spring is disposed in a use position.
FIG. 6B is a side view of the switching device in a state where the spring arm is fixed to the outer arm while the spring is disposed in the use position.

The switching device 19 is configured so that the second end 17*b* of the spring 17 can orbit around the orbital center O1. The orbital center O1 is a point that is set at the center of the proximal end 18*b* of the spring arm 18 and coincides with the pivot center of the spring arm 18. The orbital center O1 is set at a position so that the spring length when the spring 17 is disposed at the non-use position becomes the natural length. For example, as illustrated in FIGS. 6A and 6B, when the use position of the spring arm 18 is set above the shaft 15, the position of the orbital center O1 is set between a pivot center O2 of the shaft 15 and the second end 17*b* of the spring 17. In addition, the position of the orbital center O1 is set below the axis A1 of the spring 17 and near the pivot center O2 of the shaft 15.

An operation of the pedal device 10 will now be described with reference to FIGS. 6A to 8B.

FIGS. 6A and 6B each illustrate a state where the spring arm 18 is fixed to the outer arm 33*b* by disposing the spring 17 at the use position. As illustrated in FIGS. 6A and 6B, when the pedal 13 is not stepped on during the use of the pedal device 10, the chain belt 14 is pulled downward by the weight of the pedal 13. This causes the spring 17 to be pulled in the axial direction of the spring 17 while the axis A1 of the spring 17 is aligned with a straight line A2 connecting the second end 17*b* to the distal end of the cam 36 (hereinafter referred to as an end-to-end straight line). As a result, the spring length D1 is longer than the natural length of the spring 17.

Subsequently, the action of the switching device 19 when the spring arm 18 is folded to the first folding position or the second folding position during non-use of the pedal device 10 will be described with reference to FIGS. 7A to 8B.

Figure 7B:
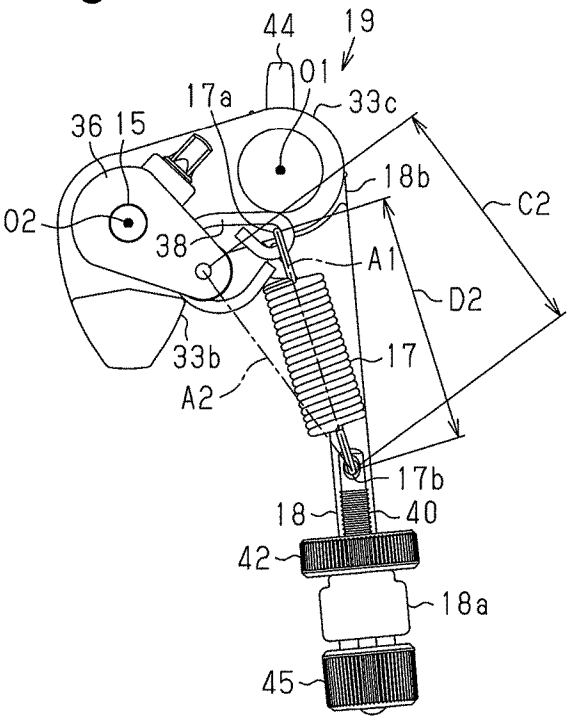
FIG. 7B is a side view of the switching device in a state where the spring arm is fixed to the outer arm while the spring is disposed in the lower non-use position.
Figure 7A:
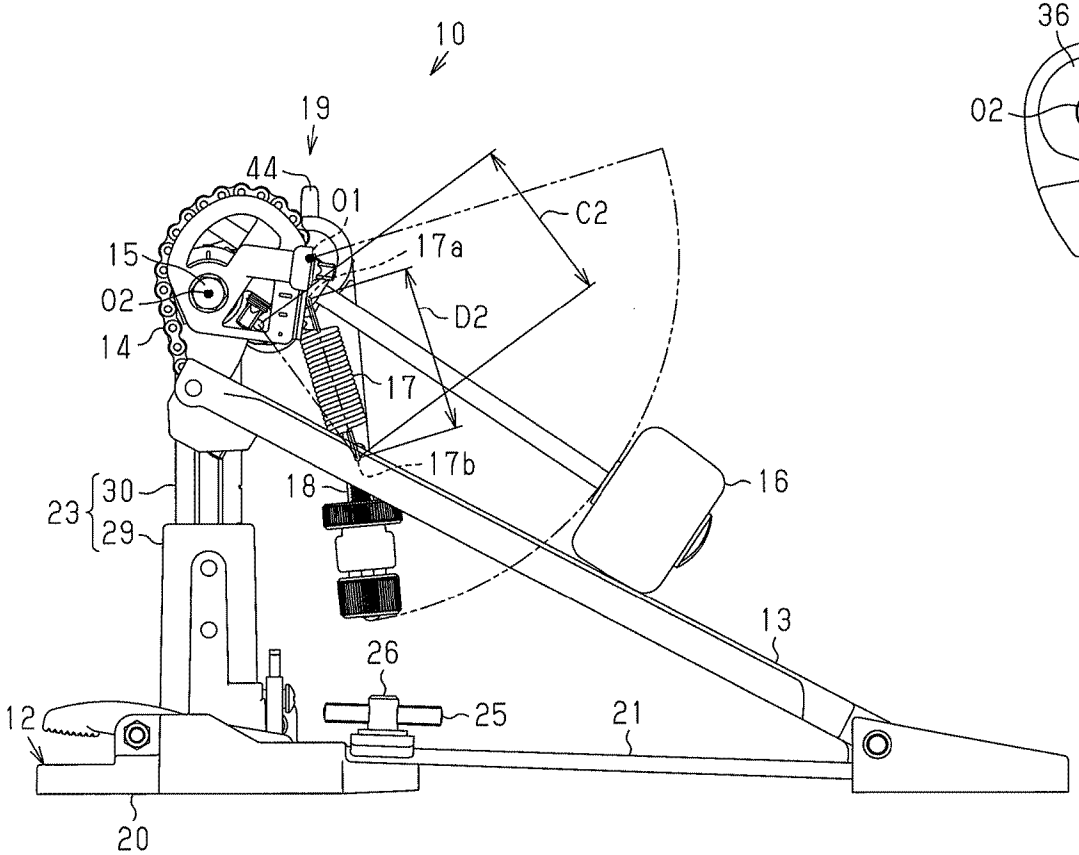
FIG. 7A is a side view of the pedal device in a state where the spring arm is fixed to the outer arm while the spring is disposed in a lower non-use position.

FIGS. 7A and 7B each illustrate a form where the spring arm 18 is folded to the first folding position. In this form, the spring arm 18 is folded while the spring 17 is disposed at the lower non-use position below the use position illustrated in FIG. 6A. To dispose the spring 17 at the lower non-use position from the use position, the user first loosens the butterfly nut 44 to allow the spring arm 18 to be pivotal with respect to the outer arm 33*b*. Then, the spring arm 18 is pivoted clockwise as illustrated in FIG. 7A, and is folded until being disposed substantially parallel to the post 23. At this time, the second end 17*b* of the spring 17 orbits around the orbital center O1 of the proximal end 18*b*.

When the spring arm 18 is folded until being disposed substantially parallel to the post 23, a distance (hereinafter referred to as an end-to-end distance) C2 between the distal end of the cam 36 and the second end 17*b* of the spring 17 becomes less than an end-to-end distance C1 during use of the pedal device 10. Then, the axis A1 of the spring 17 is not aligned with the end-to-end straight line A2, and the spring 17 is not pulled in the axial direction. As a result, the spring length D2 becomes less than the spring length D1 during the use of the pedal device 10, and finally becomes the same length as the natural length of the spring 17. This causes the tension of the spring 17 to be completely eliminated to eliminate the force holding the pedal 13 and the beater 16 generated by the spring 17.

Figure 8A:
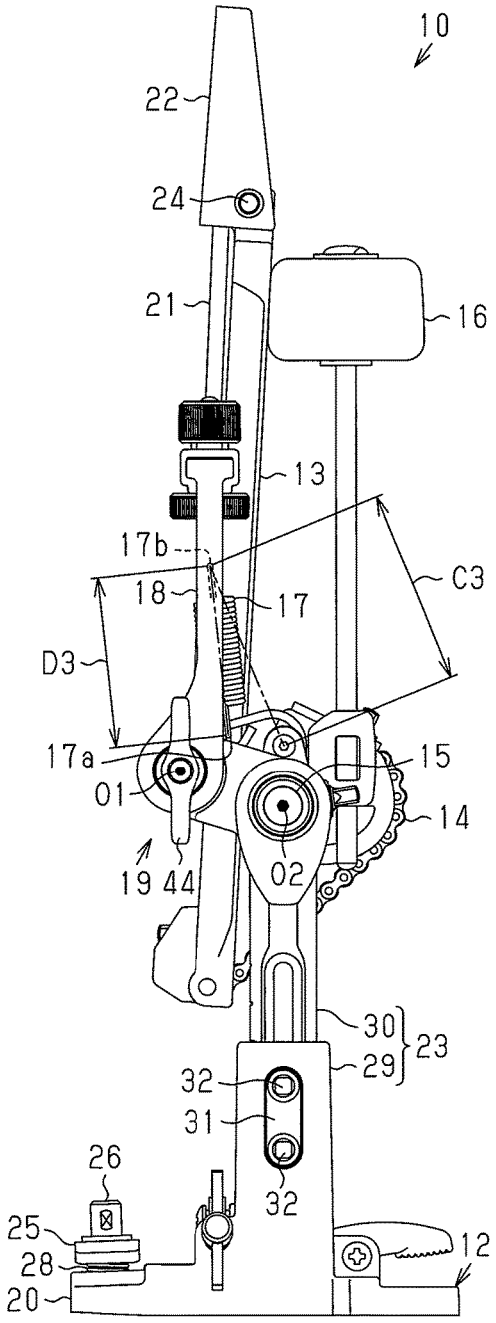
FIG. 8A is a side view of the pedal device in a state where the spring arm is fixed to the outer arm while the spring is disposed in an upper non-use position.
Figure 8B:
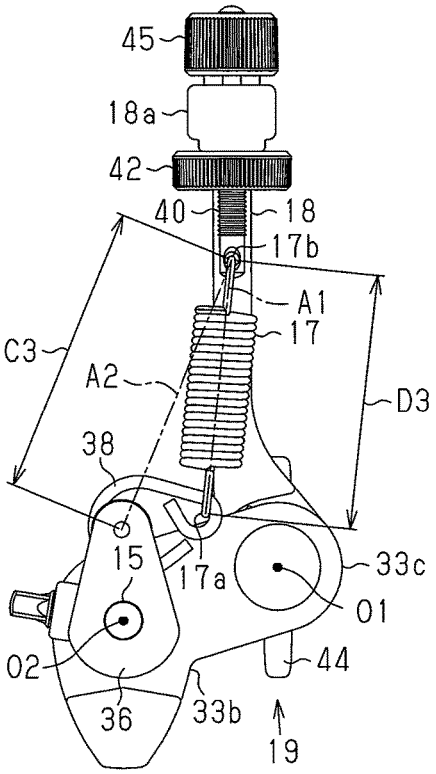
FIG. 8B is a side view of the switching device in a state where the spring arm is fixed to the outer arm while the spring is disposed in the upper non-use position.

FIGS. 8A and 8B each illustrate a form where the spring arm 18 is folded to the second folding position. In this form, the spring arm 18 is folded while the spring 17 is disposed at the upper non-use position above the use position illustrated in FIG. 6A. To dispose the spring 17 at the upper non-use position from the use position, the user first loosens the butterfly nut 44 to allow the spring arm 18 to be pivotal with respect to the outer arm 33*b*. Then, the spring arm 18 is pivoted in the direction opposite to that when the spring arm 18 is folded to the first folding position, and is folded until being disposed substantially parallel to the post 23. At this time, the second end 17*b* of the spring 17 also orbits around the orbital center O1 of the proximal end 18*b*.

When the spring arm 18 is folded until being disposed substantially parallel to the post 23, an end-to-end distance C3 becomes less than the end-to-end distance C1 during use of the pedal device 10. Then, as with when the spring arm 18 is disposed at the lower non-use position, the axis A1 of the spring 17 is not aligned with the end-to-end straight line A2, and the spring 17 is not pulled in the axial direction. As a result, the spring length D3 becomes less than the spring length D1 during use of the pedal device 10, and finally becomes the same length as the natural length of the spring 17.

Subsequent to the folding action of the spring arm 18, the user loosens the T-bolt 26 to allow the fixing plate 25 to be lifted by the spring 28, and then disengages the front end of the rod member 21 from the rear end of the base plate 20. In this state, the rod member 21 and the heel part 22 are folded together with the pedal 13 until being disposed parallel to the post 23 and the beater 16. This enables all of the rod member 21, the heel part 22, the pedal 13, the post 23, and the beater 16 to be folded in the same one direction, so that the entire pedal device 10 can be formed in a compact form.

The present embodiment achieves the following advantages.

(1) The pedal device 10 includes the switching device 19, which can selectively switch the position of the spring 17 between the use position, at which the spring 17 is disposed during the use of the pedal device 10, and the non-use position, at which the spring 17 is disposed during non-use of the pedal device 10. According to this structure, when the position of the spring 17 is switched from the use position to the non-use position by the switching device 19, the spring length is reduced. That is, when the position of the spring 17 is switched from the use position to the non-use position, the tension of the spring 17 is reduced by reducing the extension length of the spring 17. As a result, the user can fold the beater 16 to the pedal 13 by only operating the switching device 19 to reduce the force holding the pedal 13 and the beater 16 caused by the tension of the spring 17 without disengaging the spring 17 from the pedal device 10. In this case, the beater 16 is folded with respect to the pedal 13 while the tension of the spring 17 is reduced, so that the fatigue of the spring 17 while the beater 16 is folded also is reduced.

(2) The switching device 19 is configured such that the spring length when the beater 16 is folded with respect to the pedal 13 by disposing the spring 17 at the non-use position becomes the natural length of the spring 17. According to this structure, the spring 17 is disposed at the non-use position and the beater 16 is folded with respect to the pedal 13 by the switching device 19, so that the length of the spring 17 becomes the natural length to cause the tension of the spring 17 to be zero. This enables the user to fold the beater 16 to the pedal 13 after the tension of the spring 17 is eliminated. As a result, the fatigue of the spring 17 is further reduced while the beater 16 is folded.

(3) The switching device 19 is configured so that the second end 17*b* of the spring 17 can orbit around the orbital center O1. The orbital center O1 is set between the pivot center O2 of the shaft 15 and the second end 17*b* of the spring 17. According to this structure, the user can selectively switch the position of the spring 17 between the use position and the non-use position by causing the second end 17*b* of the spring 17 to orbit around the orbital center by using the switching device 19.

(4) When the use position of the spring arm 18 is set above the shaft 15, the position of the orbital center O1 is set below the axis A1 of the spring 17 and near the pivot center O2 of the shaft 15. As a result, the entire pedal device 10 does not project upward as compared with a case where the orbital center O1 of the second end 17*b* of the spring 17 is set above the axis A1 of the spring 17 when the spring 17 is disposed at the use position. This enables the pedal device 10 to be formed in a compact structure.

(5) The cam 36 and the screw 37, that fixes the cam 36 to the shaft 15, are used as a means for adjusting the angular position of each of the pedal 13 and the beater 16. In this case, the angular position of each of the pedal 13 and the beater 16 is maintained as long as the screw 37 is not loosened. That is, the angular position of each of the pedal 13 and the beater 16 does not change regardless of the pivot position of the spring arm 18. As a result, the user can selectively switch the position of the spring 17 between the use position and the non-use position while the angular position of each of the pedal 13 and the beater 16 is maintained. This allows the setting operation of the pedal device 10 to be facilitated.

(6) The switching device 19 includes the spring arm 18, the outer arm 33*b* of the upper post member 30, and the butterfly nut 44. In addition, the proximal end 18*b* of the spring arm 18 serves as the orbital center O1 of the second end 17*b* of the spring 17. According to this structure, the user can selectively switch the position of the spring 17 between the use position and the non-use position by only holding and pivoting the spring arm 18 by hand. That is, the user can selectively switch a form of the pedal device 10 between a form during use and a form during non-use by simple pivoting operation of the spring arm 18.

(7) The outer arm 33*b* of the upper post member 30 and the proximal end 18*b* of the spring arm 18 are each provided with a positioning means for a pivot position of the spring arm 18, or for disposing the spring arm 18 at the use position or one of the two different non-use positions. According to this structure, each positioning means restricts pivoting of the spring arm 18 to determine the pivot position of the spring arm 18. As a result, the user can selectively and easily switch the position of the spring 17 between the use position and the non-use position.

(8) The spring arm 18 is configured so as to be able to be placed in the first folding position for disposing the spring 17 at the lower non-use position to fold the spring arm 18, and the second folding position for disposing the spring 17 at the upper non-use position to fold the spring arm 18. As a result, the variation of the form during non-use of the pedal device 10 is increased.

(9) In a state where the front end of the rod member 21 is disengaged from the rear end of the base plate 20, the rod member 21 and the heel part 22 are folded together with the pedal 13 until being disposed parallel to the post 23. According to this structure, not only the spring arm 18 is folded while being disposed parallel to the post 23, but also the base together with the pedal 13 are disposed parallel to the post 23, so that the form of the pedal device 10 during non-use is more compact.

(10) When a typical pedal is used for a bass drum with a small diameter, the center of the drum head cannot be beaten, and thus high-quality sounds cannot be obtained. In this case, the length of the beater 16 may be adjusted to beat the center of the drum head. However, the beater 16 needs to be extremely shortened, which can cause incompatibility during drum playing, so that favorable sounds also may not be obtained. As another method, the bass drum may be installed by being lifted from the floor using a lifter. However, the operation of installing the bass drum by using a lifter is troublesome. In addition, a component such as a lifter is added for installation of the bass drum, so that the drum structure near the lifter enlarges. In this respect, the pedal device 10 is configured such that the dimension of the post 23 in its height direction is adjustable. According to this structure, the dimension of the post 23 in its height direction is adjusted to enable the position of the beater 16 to be adjusted so that the center of the drum head is beaten. That is, the pedal device 10 can be applied to a bass drum with a small diameter without not only adjusting the length of the beater 16, but also adding a component such as a lifter. In this case, the operational feeling of the pedal does not change, so that there is no incompatibility during drum playing. In addition, the center of the drum head can be beaten, so that high-quality sounds also can be obtained.

The present embodiment may be modified as follows.

Figure 9A:
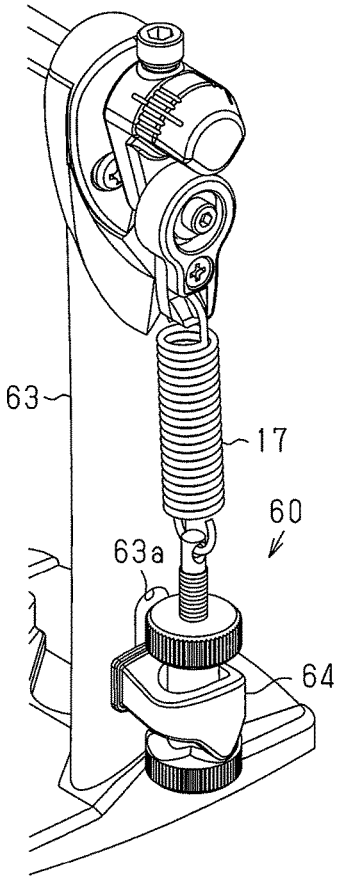
FIG. 9A is a perspective view of a switching device of a modification.
Figure 9B:
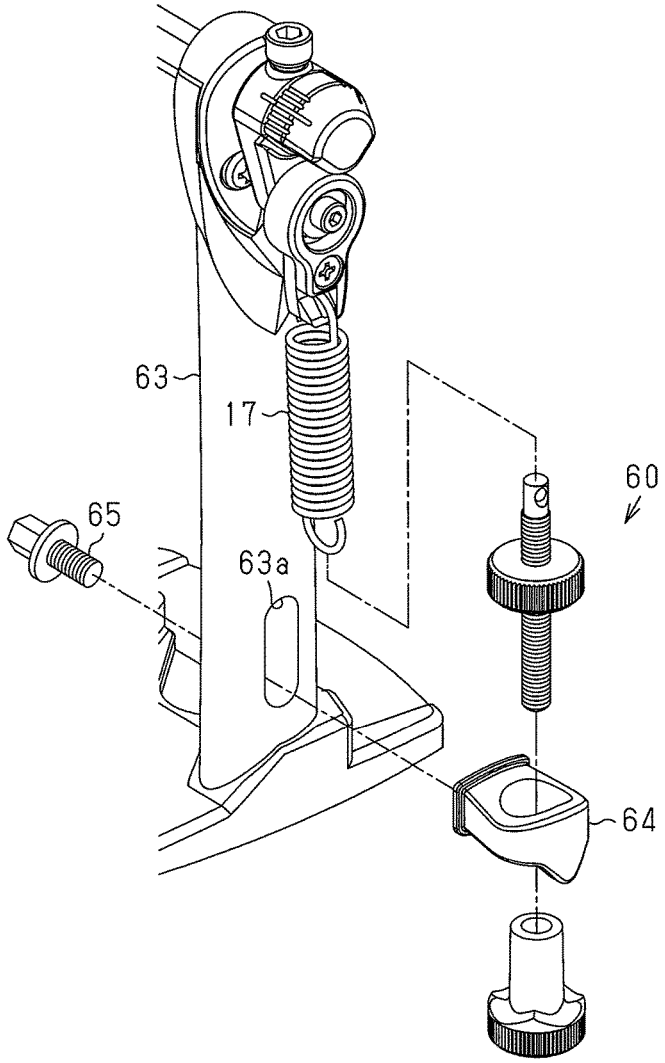
FIG. 9B is an exploded perspective view of the switching device of FIG. 9A.

For example, the structure of the switching device may be changed as illustrated in FIGS. 9A and 9B. In this case, a switching device 60 includes a post 63 having a vertical long hole 63*a*, a bracket 64 attached to the outer surface of the post 63, and a bolt 65 that is inserted into the vertical long hole 63*a* from the back side of the post 63. According to this structure, during non-use of the pedal device, the bolt 65 is first loosened to allow the bracket 64 to be slidable with respect to the post 63. Then, the bracket 64 is slid from a lower use position to an upper non-use position. This enables the user to selectively switch the position of the spring 17 between the use position and the non-use position. At this time, the spring length when the spring 17 is disposed at the non-use position is less than the spring length when the spring 17 is disposed at the use position. Thus, the tension of the spring 17 is reduced by reducing the extension length of the spring 17. As a result, the beater can be folded with respect to the pedal without disengaging the spring 17, and the fatigue of the spring 17 while the beater is folded is reduced.

When the spring 17 is disposed at the non-use position, the spring length does not need to be the natural length, and the tension of the spring 17 does not need to be zero. In this case, it is sufficient as long as the tension of spring 17 can be reduced to the extent that the beater 16 can be folded with respect to the pedal 13.

In the present embodiment, the position of the orbital center O1 is set between a pivot center O2 of the shaft 15 and the second end 17*b* of the spring 17, and more specifically is set below the axis A1 of the spring 17 when the use position of a spring arm 18 is set above the shaft 15, as well as near the pivot center O2 of the shaft 15. However, the specific position of the orbital center O1 may be determined on the basis of the design of the pedal device 10, such as the overall lengths of the spring 17 and the spring arm 18.

The spring arm 18 may be configured such that two or more forms of disposing the spring 17 at the use position can be obtained. In this case, the variation of the form during the use of the pedal device 10 is increased.

In addition, the spring arm 18 may be configured such that one form or more than two forms of disposing the spring 17 at the non-use position are obtained.

In the present embodiment, the base is composed of the base plate 20, the rod member 21, and the heel part 22, but may be composed of the heel part 22 and the base plate 20 by eliminating the rod member 21. That is, a structure allowing the base to be detachable with respect to the proximal end of the post 23 may be omitted from the pedal device 10.

In the present embodiment, the structure allowing the dimension of the post 23 in its height direction to be adjustable may be omitted from the pedal device 10.

In the present embodiment, any fixing member, such as a pin and a clamp, other than the screw 37 may be used to fix the cam 36 to the shaft 15, for example.

The invention claimed is:

1. A drum pedal device, comprising:

a device body including a base and a post extending upward from a front end of the base;

a pedal pivotally coupled to a rear end of the base;

a rotating member, which is coupled to a free end of the pedal with a coupling member and is pivotally supported to an upper end of the post;

a beater attached to the rotating member;

a spring including a first end connected to the rotating member, a second end opposite to the first end, and an axis; and a switching device capable of selectively switching a position of the spring between a use position, at which the spring is disposed during use of the pedal device, and a non-use position, at which the spring is disposed during non-use of the pedal device, wherein the switching device is configured to allow a length between the first end and the second end of the spring when the spring is disposed at the non-use position to be less than a length between the first end and the second end of the spring when the spring is disposed at the use position, the switching device is further configured to allow a length of the spring to be a natural length of the spring when the spring is disposed at the non-use position and the beater is folded with respect to the pedal, the switching device is configured to allow the second end of the spring to orbit around an orbital center, and the orbital center of the second end of the spring is set between a pivot center of the rotating member and the second end of the spring.

2. The drum pedal device according to claim 1, wherein the use position is set above the rotating member, and the orbital center of the second end of the spring is set below the axis of the spring when the spring is disposed at the use position.

3. The drum pedal device according to claim 1, further comprising:

a cam, which is attached to the rotating member and is connected to the first end of the spring; and a fixing member, which fixes the cam to the rotating member, wherein the pedal device is configured to allow an angular position of each of the beater and the pedal to be adjustable by pivoting the rotating member after the fixing member releases the cam from the rotating member.

4. The drum pedal device according to claim 1, further comprising:

a spring arm including a proximal end, which is pivotally attached to the post, and a distal end, which is connected to the second end of the spring, wherein the proximal end of the spring arm serves as the orbital center of the second end of the spring.

5. The drum pedal device according to claim 4, wherein at least one of the post and the spring arm is provided with a positioning means for determining a pivot position of the spring arm.

6. The drum pedal device according to claim 4, wherein the non-use position is one of two non-use positions that include a lower non-use position positioned below the use position and an upper non-use position positioned above the use position, and the spring arm is capable of being placed in a first folding position, at which the spring arm is folded while the spring is disposed at the lower non-use position, and a second folding position, at which the spring arm is folded while the spring is disposed at the upper non-use position.

7. The drum pedal device according to claim 6, wherein the spring arm is foldable while being disposed parallel to the post, the base is detachable with respect to a proximal end of the post, and the base is capable of being disposed together with the pedal parallel to the post while being detached from the post.

8. The drum pedal device according to claim 1, wherein a dimension of the post in its height direction is adjustable.

* * * * *